US008001947B2

(12) United States Patent
Ando et al.

(10) Patent No.: US 8,001,947 B2
(45) Date of Patent: Aug. 23, 2011

(54) PISTON FOR INTERNAL-COMBUSTION ENGINES

(75) Inventors: Kimihiko Ando, Toyota (JP); Hitoshi Tanino, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 466 days.

(21) Appl. No.: 12/227,433

(22) PCT Filed: May 22, 2007

(86) PCT No.: PCT/JP2007/060764

§ 371 (c)(1),
(2), (4) Date: Dec. 22, 2008

(87) PCT Pub. No.: WO2007/136130

PCT Pub. Date: Nov. 29, 2007

(65) Prior Publication Data

US 2009/0126676 A1 May 21, 2009

(30) Foreign Application Priority Data

May 24, 2006 (JP) ..... 2006-144197

(51) Int. Cl.
*F02F 3/00* (2006.01)

(52) U.S. Cl. ..... 123/193.6; 92/228

(58) Field of Classification Search ..... 92/208, 92/222, 228, 231; 123/193.6; 29/888.04
See application file for complete search history.

(56) References Cited

U.S. PATENT DOCUMENTS

| | | | | | |
|---|---|---|---|---|---|
| 4,292,936 | A * | 10/1981 | Morishita et al. | ..... | 123/193.6 |
| 4,552,057 | A * | 11/1985 | Mizuhara | ..... | 92/176 |
| 4,648,308 | A * | 3/1987 | Matsui et al. | ..... | 92/212 |
| 4,667,627 | A * | 5/1987 | Matsui et al. | ..... | 123/193.6 |
| 6,244,161 | B1 * | 6/2001 | Myers et al. | ..... | 92/224 |
| 2003/0136475 | A1 | 7/2003 | Kruger et al. | | |
| 2007/0234994 | A1 * | 10/2007 | Wang | ..... | 123/193.1 |

FOREIGN PATENT DOCUMENTS

| | | |
|---|---|---|
| EP | 1 612 395 A1 | 1/2006 |
| GB | 1 467 644 | 3/1977 |
| GB | 2 164 701 A | 3/1986 |
| JP | A-61-129419 | 6/1986 |
| JP | A-5-44574 | 2/1993 |
| JP | A-11-193721 | 7/1999 |
| JP | A-2000-186617 | 7/2000 |
| JP | A-2001-240902 | 9/2001 |
| JP | A-2002-364370 | 12/2002 |
| JP | A-2004-104015 | 4/2004 |
| JP | A-2005-116680 | 4/2005 |
| JP | A-2006-83437 | 3/2006 |

* cited by examiner

*Primary Examiner* — M. McMahon
(74) *Attorney, Agent, or Firm* — Oliff & Berridge, PLC

(57) ABSTRACT

Disclosed is a piston for internal-combustion engines, which includes a low thermal-conductive member disposed at the top portion thereof, the low thermal-conductive member including an alloy containing Fe and Mn. The low thermal-conductive member includes a sintered body having 10~60 mass % of Mn, 2 mass % or less of C, and the balance of Fe and inevitable impurities. Since the piston has the low thermal-conductive member having low thermal conductivity and thermal expansion properties similar to those of the aluminum alloy, which is the base metal of the piston, an increase in the temperature of a combustion chamber and vaporization of fuel are effectively promoted. Furthermore, thermal fatigue failure and separation of the low thermal-conductive member are prevented.

3 Claims, 4 Drawing Sheets

PISTON FOR INTERNAL-COMBUSTION ENGINES

BACKGROUND OF THE INVENTION

1. Field of the Invention

The present invention relates to a piston for internal-combustion engines. More particularly, the present invention relates to a piston for in-cylinder injection-type internal-combustion engines, including diesel engines or direct injection-type gasoline engines.

2. Description of the Related Art

In pistons for internal-combustion engines, such as diesel engines or gasoline engines, there has been known a piston for internal-combustion engines, which has a low thermal-conductive member having low thermal conductivity at the top surface of the piston, which collides with the injected combustion gas, to thus inhibit the conduction of heat from the fuel collision part to the main body of the piston, thereby preventing the production of unburned hydrocarbons or smoke upon cold operations, such as when starting the internal-combustion engine.

For example, Japanese Unexamined Patent Publication No. 2000-186617 discloses a structure in which a low thermal-conductive member formed of a sintered titanium alloy material is mounted to the top portion (fuel collision part) of a piston made of an aluminum alloy. Since the sintered titanium alloy material has thermal conductivity corresponding to about 1/10 of the aluminum alloy used for the main body of the piston, the temperature of the wall surface of the combustion chamber of the piston is increased, and thus the atomization of fuel is promoted, resulting in improved combustion.

However, a rate of thermal expansion of the titanium alloy which is used for the low thermal-conductive member different from that of the aluminum alloy, and thus thermal fatigue failure undesirably occurs.

SUMMARY OF THE INVENTION

Accordingly, the present invention has been made keeping in mind the above problems occurring in the related art, and an object of the present invention is to provide a piston for internal-combustion engines, which includes a low thermal-conductive member having low thermal conductivity and a thermal expansion coefficient approximate to that of the aluminum alloy used as the base metal of the piston.

The present inventors have discovered an optimized alloy composition, based on the fact that thermal conductivity of Mn is about 1/10 of that of Fe and the linear expansion coefficient thereof is about two times that of Fe, and have thus obtained a desired low thermal-conductive member, therefore completing the present invention.

The piston for internal-combustion engines of the present invention may be a piston for internal-combustion engines having a low thermal-conductive member disposed at the top portion thereof, the low thermal-conductive member being composed of an alloy including 10~60 mass % of Mn and a balance of Fe and inevitable impurities.

In the piston for internal-combustion engines of the present invention, the low thermal-conductive member may further include 2 mass % or less of C. Such a low thermal-conductive member is preferably a sintered body comprising 10~60 mass % of Mn, 2 mass % or less of C, and the balance of Fe and inevitable impurities.

In the piston for internal-combustion engines of the present invention, the low thermal-conductive member is preferably a sintered body.

BRIEF DESCRIPTION OF THE DRAWINGS

The above and other objects and features of the present invention will become apparent from the following description of preferred embodiment, given in conjunction with the accompanying drawings, in which.

DETAILED DESCRIPTION OF THE PREFERRED EMBODIMENTS

Various embodiments of the present invention will now be described in detail with reference to the accompanying drawings.

Figure 1:
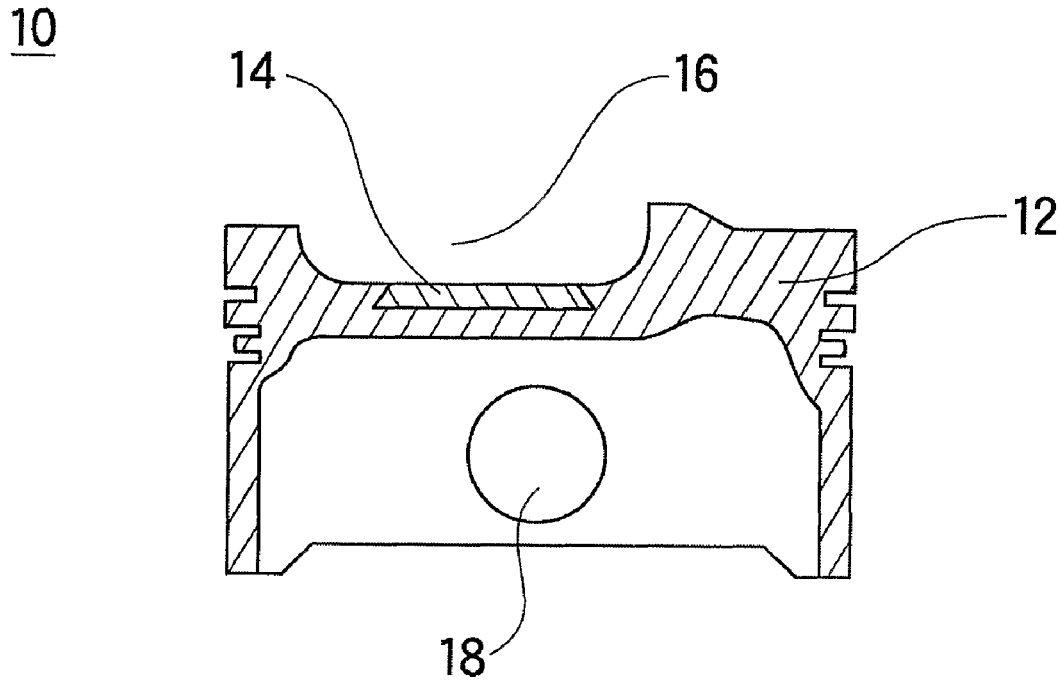
FIG. 1 is a schematic sectional view showing the main parts of a piston according to the present invention.

FIG. 1 is a schematic sectional view showing the piston according to the embodiment of the present invention.

In the present invention, the piston 10 includes a main body 12 and a low thermal-conductive member 14 mounted to the top surface thereof.

The main body 12 of the piston is formed by casting an aluminum alloy (which is referred to as a "base metal of a piston"), for example, AC8A. In the top surface of the main body 12 of the piston, a recess 16, which defines a combustion chamber along with a cylinder head (not shown) and a cylinder, is formed. The reference number 18 designates a pin hole for inserting a piston pin.

The fuel is injected toward the recess 16, and the low thermal-conductive member 14 is mounted at the portion (fuel collision part) at which the injected fuel contacts the recess 16. Since the low thermal-conductive member 14 has much lower thermal conductivity than the aluminum alloy, it is possible to efficiently increase the temperature thereof to thus promote vaporization of the fuel.

In the embodiment of the present invention, the low thermal-conductive member 14 is formed with a sintered body of an Fe—Mn alloy having low thermal conductivity. The Fe—Mn alloy sintered body has lower thermal conductivity than a conventional titanium alloy sintered body and also has a linear expansion coefficient very approximate to that of the aluminum alloy (AC8A), which is the base metal of the piston. Thus, when the low thermal-conductive member 14 is mounted to the top surface of the piston, tensile stress is not applied to parts adjacent to the aluminum alloy upon operation of the internal-combustion engine, thereby a good mounting state is maintained.

Figure 2:
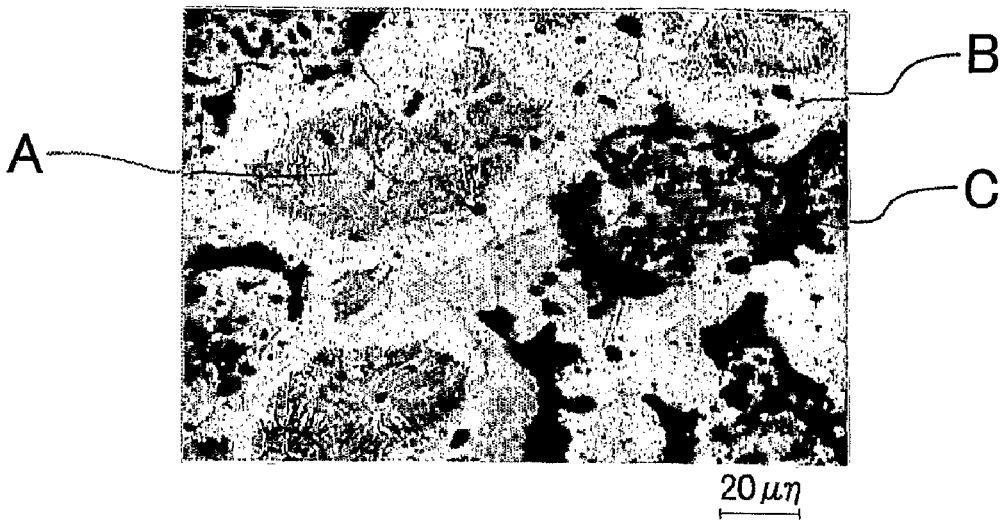
FIG. 2 is a micrograph showing the metal texture of the low thermal-conductive member according to a preferred embodiment of the present invention.

FIG. 2 is a micrograph showing the texture of the low thermal-conductive member (sintered body) according to the embodiment of the present invention. The sintered body is obtained by mixing Fe—Mn alloy powder with pure iron powder and graphite at a predetermined mixing ratio, and then sintering the mixture through a predetermined process. In the drawing, A designates the Fe—Mn alloy powder, B designates pure iron powder, and C designates porosity. Further, carbon diffuses and thus is distributed almost uniformly. The pure iron powder B placed around the Fe—Mn alloy powder A constitutes an austenite phase through the diffusion of Mn of the alloy powder A, and this austenite phase is considered to contribute to the decrease in the thermal conductivity of the sintered body and to the increase in the linear expansion coefficient thereof.

Figure 3:
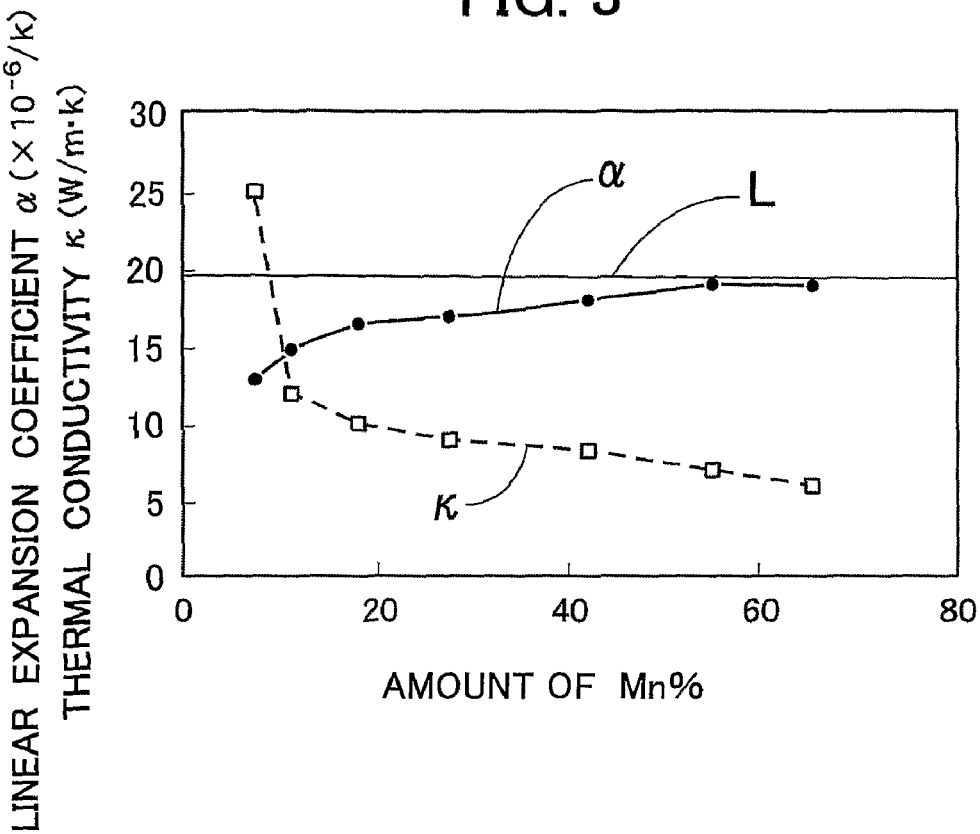
FIG. 3 is a graph showing the variation in linear expansion coefficient and thermal conductivity of the low thermal-conductive member (sintered body), depending on the amount of Mn.

The thermal conductivity and linear expansion coefficient of the sintered body vary depending on the amount of Mn. As shown in FIG. 3, as the amount of Mn is increased, the linear expansion coefficient $\alpha$ (●) is increased, and the thermal conductivity $\kappa$ (□) is decreased. In FIG. 3, showing the linear expansion coefficient ($\alpha=19.5\times10^{-6}$/K) of an aluminum alloy (AC8A) represented by a transverse line L, when the amount of Mn is high, the linear expansion coefficient of the sintered body is seen to be approximate to the linear expansion coefficient of the base metal of the piston.

Figure 4:
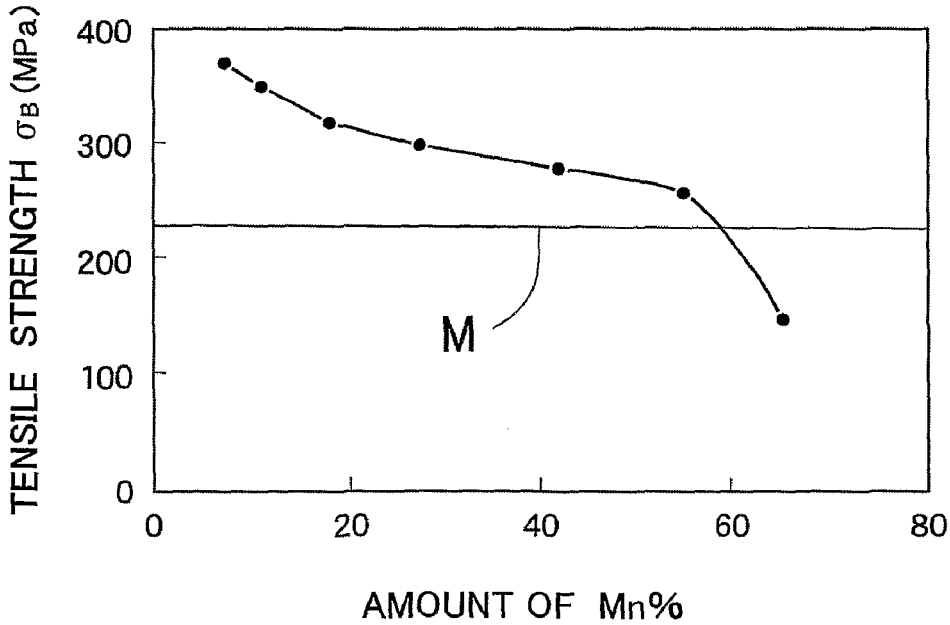
FIG. 4 is a graph showing the variation in tensile strength of the low thermal-conductive member (sintered body), depending on the amount of Mn.

Further, the strength of the sintered body varies depending on the amount of Mn thereof. As seen in FIG. 4, when the amount of Mn is increased, the tensile strength $\sigma B$ of the sintered body is decreased. Since the tensile strength of AC8A, which is the base metal of the piston, is 230 MPa, as represented by the transverse line M, using Mn in an amount exceeding 60 mass % is not advisable.

As mentioned above, the amount of Mn in the sintered body (low thermal-conductive member 14) is preferably 10~60 mass %, and more preferably, 15~40 mass %.

Figure 5:
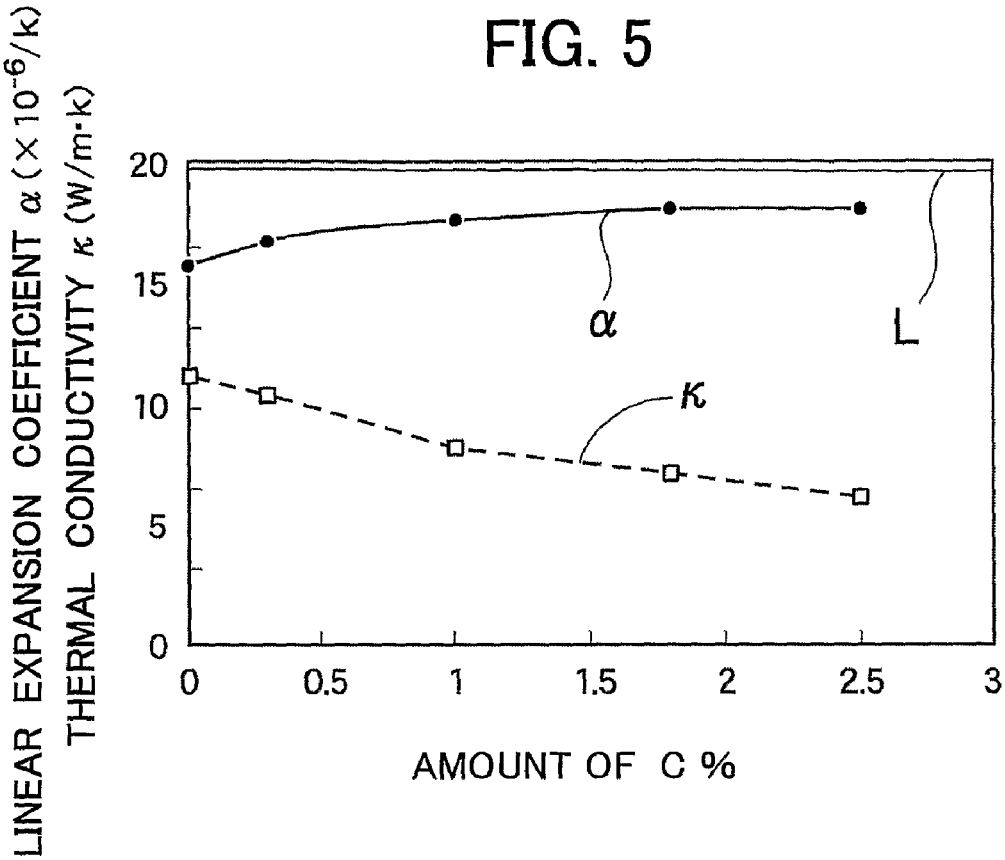
FIG. 5 is a graph showing the variation in linear expansion coefficient and thermal conductivity of the low thermal-conductive member (sintered body), depending on the amount of C.
Figure 6:
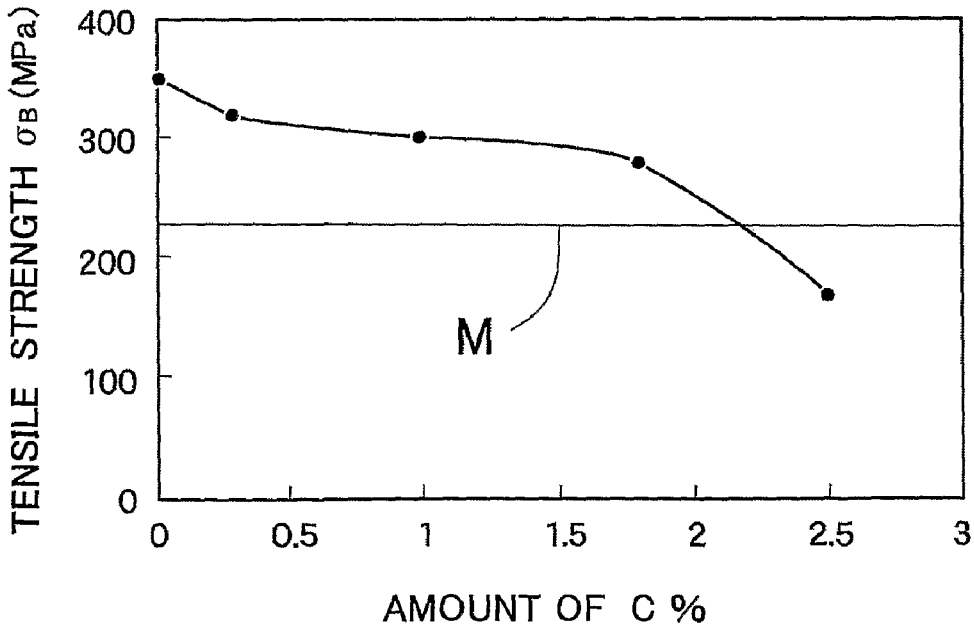
FIG. 6 is a graph showing the variation in tensile strength of the low thermal-conductive member (sintered body), depending on the amount of C.

The sintered body may further include C. When C is contained in the Fe—Mn alloy, the linear expansion coefficient of the sintered body is increased further and the thermal conductivity may be decreased. FIG. 5 shows the variation in the thermal conductivity $\kappa$ and linear expansion coefficient $\alpha$ of the sintered body depending on the amount of C, and FIG. 6 shows the variation in the tensile strength $\sigma B$ of the sintered body depending on the amount of C. As shown in FIG. 5, as the amount of C increases, the linear expansion coefficient $\alpha$ (●) increases, and the thermal conductivity $\kappa$ (□) decreases.

In FIG. 6, the tensile strength of the sintered body is seen to be decreased in inverse proportion to the increase in the amount of C. In the case where the amount of C exceeds 2 mass %, the tensile strength of the sintered body becomes lower than the tensile strength of the aluminum alloy.

As is apparent from FIGS. 5 and 6, the amount of C of the sintered body (low thermal-conductive member 14) is preferably 2 mass % or less, and more preferably 0.3~1.5 mass %.

The low thermal-conductive member 14, composed of the above sintered body, may be formed through a material preparation process, a molding process, and a sintering process.

In the material preparation process, powder materials (Fe—Mn alloy powder, Mn powder, graphite, iron) are mixed until uniform, so that the amount of Mn is 10~60 mass % and the amount of C is 2 mass % or less. Although the individual powder materials are not particularly limited, the Fe—Mn alloy powder may comprise gas atomized powder having a diameter of about 20~150 μm, the Mn powder may comprise powder obtained by grinding Mn nodules having a diameter of about 10~50 μm, the graphite may comprise graphite powder having a diameter of about 3~50 μm, and the iron may comprise pure iron powder having a diameter of about 20~150 μM.

In the molding process, the powder material mixture is placed in a mold or molds, and is then subjected to compression molding to form a predetermined shape. Upon the compression molding, the load with which the powder materials are compressed is controlled so that the strength and porosity of the sintered body are set within a desired range. In the embodiment of the present invention, the compression load is preferably set to 500~1000 MPa. When the compression load is less than 500 MPa, the strength of the sintered body is insufficient. On the other hand, when the load exceeds 1000 MPa, the mold/molds undesirably galls/gall and aggregate by itself/themself. The compression load preferably ranges from 600 MPa to 800 MPa.

Subsequently, in the sintering process, the compression molded product is sintered at 1100~1300° C. for 10~60 min, thereby obtaining a sintered body (low thermal-conductive member 14). If the sintering temperature is lower than 1100° C., the strength becomes insufficient. On the other hand, if the temperature is higher than 1300° C., coarse porosities are generated undesirably. The sintering temperature preferably ranges from 1150° C. to 1250° C.

The sintering process is preferably conducted in a nitrogen gas atmosphere, in which nitrogen partial pressure is about 0.1~1 atm. This is because the Fe—Mn alloy powder, which is easily oxidized, is mainly oxidized in a general RX gas atmosphere, and also because the strength thereof is decreased.

Since the piston for internal-combustion engines according to the present invention has the low thermal-conductive member of the Fe—Mn alloy, which has low thermal conductivity, disposed in the top surface thereof, the increase in the temperature of the combustion chamber of the internal-combustion engine and the vaporization of fuel may be effectively promoted.

The linear expansion coefficient of the Fe—Mn alloy is controlled to be approximate to the linear expansion coefficient of the aluminum alloy, which is the base metal of the piston, and thus, it is possible to prevent the generation of thermal fatigue failure or separation of the low thermal-conductive material due to the difference in thermal expansion between the base metal of the piston and the low thermal-conductive member.

Moreover, when C is added, the linear expansion coefficient of the low thermal-conductive member is further increased, and the thermal conductivity thereof may be decreased. Therefore, the increase in the temperature of the combustion chamber of the internal-combustion engine and the vaporization of fuel may be further promoted, and the state in which the low thermal-conductive member is mounted to the base metal of the piston may be stably maintained.

The low thermal-conductive member is composed of the sintered body of the Fe—Mn alloy powder, thereby further decreasing the thermal conductivity. Such a sintered body is obtained through sintering in a nitrogen atmosphere, and thus powder oxidation is low and elemental diffusion between the powders is not impeded, consequently increasing the strength of the sintered body.

Examples

The low thermal-conductive member of the present invention is specifically described through the following test examples.

(Production of Samples)

Using powder materials shown in Table 1 below, the sintered bodies of the examples and comparative examples of the present invention were produced.

TABLE 1

| | Chemical Component (mass %) | | | | | | Production |
|---|---|---|---|---|---|---|---|
| Material | Mn | Ni | Cr | C | Ti | Fe | Process |
| A | 49.7 | — | — | 0.003 | — | Balance | Gas Atomizing |
| B | Balance | — | — | 0.03 | — | 0.05 | Crushing |
| C | — | 11 | 18.7 | 0.013 | — | Balance | Gas Atomizing |
| D | — | — | — | 0.05 | Balance | — | Kroll |

Gas atomized powder (A), having a diameter of 150 μm or less, and comprising 49.7 mass % of Mn, with the balance being substantially iron, or powder (B), comprising 0.05 mass % of iron, with the balance being substantially Mn in a state in which Mn nodules were ground, was mixed with graphite and iron powder at the mixing ratios shown in Table 2 below.

The powder mixture, which had been mixed at a predetermined ratio, was mixed until uniform using a V-shaped powder mixer, placed in a mold or molds, and subjected to compression molding using a press, thus producing a molded product having a length of 50 mm×a width of 10 mm×a thickness of 10 mm in a plate shape. For this, the press was used at a pressure of 800 MPa.

The resultant molded product was sintered under conditions of 1150° C.×30 min in a nitrogen atmosphere, in which nitrogen partial pressure was 0.13 atm, thus obtaining sintered bodies Nos. 1~11.

For comparison, using water atomized powder (C) of SUS 304, having a diameter of 150 μm or less and comprising 11 mass % of Ni and 18.7 mass % of Cr, with the balance being substantially iron, and using Ti powder, obtained through a kroll process, each molded product having a length of 50 mm×a width of 10 mm×a thickness of 10 mm in a plate shape was produced. As such, the press was used at a pressure of 800 MPa. The resultant molded product was sintered under conditions of 1150° C.×30 min in a vacuum atmosphere, thus obtaining a stainless sintered body No. 12 and a titanium sintered body No. 13.

TABLE 2

| | Powder Material Mixing Ratio (mass %) | | | | Chemical Component of Sintered Body (mass %) | | |
|---|---|---|---|---|---|---|---|
| Sample | Alloy Powder | | | | | | |
| No. | Type | Amount | Graphite | Iron | Mn | C | Fe |
| 1 | A | 36 | 0.3 | 63.7 | 18 | 0.3 | Balance |
| 2 | A | 22 | 0.3 | 77.7 | 11 | 0.3 | Balance |
| 3 | A | 55 | 0.3 | 44.7 | 27.5 | 0.3 | Balance |
| 4 | B | 42 | 0.3 | 57.7 | 42 | 0.3 | Balance |
| 5 | B | 55 | 0.3 | 44.7 | 55 | 0.3 | Balance |
| 6 | A | 36 | — | 64 | 18 | — | Balance |
| 7 | A | 36 | 1 | 63 | 18 | 1 | Balance |
| 8 | A | 36 | 1.8 | 62.2 | 18 | 1.8 | Balance |
| 9 | A | 15 | 0.3 | 84.7 | 7.5 | 0.3 | Balance |
| 10 | B | 65 | 0.3 | 34.7 | 65 | 0.3 | Balance |
| 11 | A | 36 | 2.5 | 61.5 | 18 | 2.5 | Balance |
| 12 | C | 100 | — | — | Fe—19%Cr—11%Ni | | |
| 13 | D | 100 | — | — | Ti | | |

(Measurement Method)

From each of the sintered bodies Nos. 1~13, a test piece was appropriately cut, and the thermal conductivity κ (W/(m·K)), linear expansion coefficient α ($\times 10^{-6}$/K) and tensile strength σB (MPa) thereof were measured.

The thermal conductivity κ was determined according to the test method of thermal diffusivity/specific heat capacity/thermal conductivity, based on a laser flash method of JIS R 1611 (1997), and the linear expansion coefficient α was determined in a manner such that the sample was disposed between the end of a sample support and a detection rod, and the displacement of the detection rod in response to a change in the length of the sample due to temperature change was measured using a displacement meter. The tensile strength σB was determined by cutting the test piece from the sintered body sample according to a prescription for test pieces for metal sintered bodies, set forth by the Japan Society of Powder and Powder Metallurgy, and by conducting measurements according to JIS Z 8401.

Figure 7:
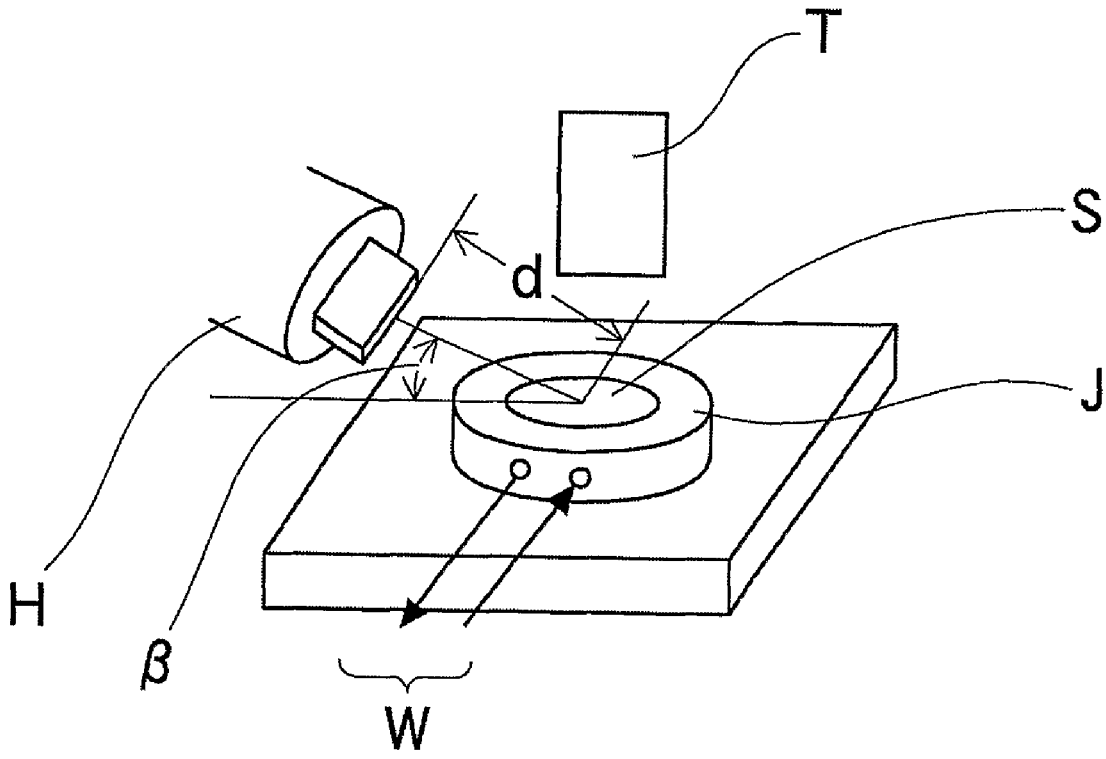
FIG. 7 is a view showing the process of measuring the temperature increase rate.

The temperature increase rate ν (° C./min) was determined as shown in FIG. 7. That is, a sintered body disk S obtained through the above molding process and having a thickness of 3 mm×a diameter of 30 mm was mounted to the central portion of a holder J (thickness 10 mm×diameter 75 mm) formed of AC8A, which was the same material as the base metal of a piston, cooling water W was made to flow in the holder J in the direction indicated by the arrow, and the center of the disk S was heated using a heater H to thus measure the surface temperature change of the disk S using an IR radiation thermometer T. The heater H was a heater blower for continuously supplying hot air at 450° C., and was installed at an angle of β=40° with respect to the horizontal surface. The heater was spaced apart by d=80 mm from the center of the sample disk S to thus supply the hot air.

(Test Results)

Along with the properties (Sample No. 14) of the aluminum alloy (cast material of AC8A) used as the base metal of a piston, the test results are shown in Table 3 below:

TABLE 3

| Sample No. | Thermal Expansion Coeff. ($\times 10^{-6}$/K) | Thermal Conductivity (W/m · K) | Temperature Increase Rate (° C./min) | Tensile Strength (MPa) | Note |
|---|---|---|---|---|---|
| 1 | 16.6 | 10.3 | 150 | 320 | Ex. |
| 2 | 15 | 12 | 130 | 350 | Ex. |
| 3 | 17 | 9 | 170 | 300 | Ex. |
| 4 | 18 | 8 | 180 | 280 | Ex. |
| 5 | 19 | 7 | 190 | 260 | Ex. |
| 6 | 15.5 | 11 | 140 | 350 | Ex. |
| 7 | 17.5 | 8 | 170 | 300 | Ex. |
| 8 | 18 | 7 | 185 | 280 | Ex. |
| 9 | 13 | 25 | 80 | 370 | C. Ex. |
| 10 | 19 | 6 | 200 | 200 | C. Ex. |
| 11 | 18 | 6 | 190 | 150 | C. Ex. |
| 12 | 16.5 | 16 | 100 | ? | SUS304 |
| 13 | 9 | 17 | 100 | 310 | Ti |
| 14 | 19.5 | 134 | 50 | 230 | AC8A |

The thermal conductivity κ of the samples Nos. 1~8 was determined to be 7~10.3 W/m·K, which was lower than SUS 304 (16 W/m·K) of the sample No. 12 or titanium (17 W/m·K) of the sample No. 13, having relatively low thermal conductivity K among iron-based materials. Thus, in the sintered bodies Nos. 1~8, corresponding to the examples of the present invention, the temperature increase rate ν (° C./min) was determined to be 130~190° C./min, which was higher than the temperature increase rate (ν=100° C./min) of SUS 304 or titanium.

The samples Nos. 1~8, corresponding to the examples of the present invention, had a linear expansion coefficient α of 15~19×$10^{-6}$/K. The linear expansion coefficients of sample No. 2, including an amount of Mn as small as 11 mass %, and sample No. 6, having no C, were slightly lower than SUS304 (16.5×$10^{-6}$/K) of sample No. 12, but were higher than titanium (9×$10^{-6}$/K) of sample No. 13, and were approximate to the linear expansion coefficient $\alpha$=19.5×$10^{-6}$/K of the aluminum alloy used as the base metal of the piston.

The comparative example of the sample No. 9, in which the amount of Mn was 7.5 mass %, out of the range of the present invention, had thermal conductivity ($\kappa$=25) higher than that of SUS 304 or titanium, resulting in low temperature increase rates. That is, in the low thermal-conductive member of the sample No. 9, the injected fuel could not be efficiently evaporated.

In the comparative example of the sample No. 10, comprising 65 mass % of Mn, which exceeds the range of the present invention, both the linear expansion coefficient $\alpha$ and the thermal conductivity $\kappa$ were superior to those of the inventive examples (Nos. 1~8), but the tensile strength $\sigma B$ was determined to be 200 MPa, which was lower than the tensile strength ($\sigma B$=230 MPa) of the base metal of the piston, undesirably resulting in an increased probability of breakdown and separation occurring.

The comparative example of the sample No. 11 had 2.5 mass % of C, exceeding the range of the present invention. Both the linear expansion coefficient $\alpha$ and the thermal conductivity $\kappa$ were equal to those of the examples (Nos. 1~8) of the present invention, but the tensile strength $\sigma B$ was determined to be 150 MPa, which was much lower than the tensile strength of the sample No. 10, undesirably resulting in an increased probability of breakdown and separation occurring.

The amounts of Mn and C were set within the range of the present invention, thereby obtaining a low thermal-conductive member having low thermal conductivity and a linear expansion coefficient approximate to the linear expansion coefficient of the aluminum alloy used as the base metal of a piston.

The sample No. 1 was placed in a predetermined mold or molds, preheated to 400° C., cast with an aluminum alloy (AC8A) melt at 740° C., cooled, cut, and observed using a microscope for metal interfacial adhesion between the sintered body and the aluminum alloy (AC8A). When observed under 50× magnification, almost no separation (pores) between the sintered body and the aluminum alloy (AC8A) was observed, and on this basis the adhesion was estimated to be high.

As mentioned above, the low thermal-conductive member, disposed in the top surface of the piston of the present invention, has very low thermal conductivity and a linear expansion coefficient approximate to that of the base metal of the piston. Thus, the piston of the internal-combustion engine, in which the low thermal-conductive member is provided at the top portion of the piston, colliding with the injected fuel, improves the formation of the air mixture in a warm-up procedure when starting the engine when the temperature of the piston is low, or upon low load operation, making it possible to inhibit the production of unburned hydrocarbons and smoke and to improve the combustion of the internal-combustion engines.

In the piston of the internal-combustion engine having the low thermal-conductive member, because the thermal expansion coefficients of the base metal of the piston and the low thermal-conductive member are similar to each other, fatigue failure due to the difference in thermal expansion is not easily generated. Therefore, the mounting state between the main body of the piston and the low thermal-conductive member can be stably maintained.

The piston for internal-combustion engines, according to the present invention, is not limited to the above examples, and may be changed within a scope that does not depart from the technical spirit of the present invention. For instance, although the sintered body of Fe—Mn alloy powder has been used for the low thermal-conductive member in the above examples, the low thermal-conductive member may be formed in a plate shape using a cast material, as long as the low thermal-conductive member contains an amount of Mn within the range of the present invention. Further, although the mixture of iron and Mn has been used for the powder material in the above examples, an alloy powder containing Mn may be applied. In the case where it is possible to subject the alloy powder to compression molding to thus produce a hard molded product, uniformity of materials may be realized.

INDUSTRIAL APPLICABILITY

According to the present invention, a piston for internal-combustion engines includes a low thermal-conductive member having a linear expansion coefficient approximate to that of the base metal of the piston and low thermal conductivity at the top surface thereof, and thus is suitable for use as a piston for diesel engines or direct injection-type gasoline engines.

While the invention has been shown and described with respect to the preferred embodiments, it will be understood by those skilled in the art that various changes and modifications may be made without departing from the spirit and scope of the invention as defined in the following claims.

The invention claimed is:

1. A piston for internal-combustion engines, comprising a low thermal-conductive member disposed at a top portion thereof, the low thermal-conductive member being composed of an alloy including 10~60 mass % of Mn and a balance of Fe and inevitable impurities.

2. The piston according to claim 1, wherein the low thermal-conductive member further comprises 2 mass % or less of C.

3. The piston according to claim 1, wherein the low thermal-conductive member comprises a sintered body.

* * * * *